United States Patent [19]

Webster et al.

[11] Patent Number: 4,811,577

[45] Date of Patent: Mar. 14, 1989

[54] PORTABLE LOCKING DEVICE

[76] Inventors: Noel E. Webster, 4811 Alhambra Ave., Martinez, Calif. 94553; Kimberly Meredith, 3118 Jen Ct., Concord, Calif. 94518

[21] Appl. No.: 88,398

[22] Filed: Aug. 21, 1987

Related U.S. Application Data

[63] Continuation of Ser. No. 881,217, Jul. 2, 1986, abandoned.

[51] Int. Cl.[4] ..... E05B 73/00

[52] U.S. Cl. ..... 70/14; 70/49; 70/58; 70/63; 70/66; 70/18

[58] Field of Search ..... 70/14, 18, 20–22, 70/30, 31, 49, 66, 57–63, 233, 234; 211/4–9

[56] References Cited

U.S. PATENT DOCUMENTS

| | | | |
|---|---|---|---|
| 2,574,967 | 11/1951 | Gossner | 70/49 |
| 3,867,823 | 2/1975 | Waltower | 70/63 X |
| 3,906,758 | 9/1975 | Hurwitt | 70/49 X |
| 3,950,972 | 4/1976 | Bleier et al. | 70/49 X |
| 3,999,409 | 12/1976 | Bell | 70/58 |
| 3,999,410 | 12/1976 | Hall | 70/18 X |
| 4,012,930 | 3/1977 | Benson | 70/49 X |
| 4,023,387 | 5/1977 | Gould | 70/49 X |
| 4,398,403 | 8/1983 | Menick | 70/18 X |
| 4,474,116 | 10/1984 | Castenada, Jr. et al. | 70/63 X |
| 4,573,332 | 3/1986 | Ma | 70/30 |
| 4,691,539 | 9/1987 | Gover | 70/18 |
| 4,756,171 | 7/1988 | Homar | 70/18 |

*Primary Examiner*—Robert L. Wolfe
*Assistant Examiner*—Suzanne L. Dino
*Attorney, Agent, or Firm*—Phillips, Moore, Lempio & Finley

[57] ABSTRACT

A compact portable locking device designed primarily to be utilized in conjunction with coats, bicycles, skis and the like is disclosed. The device takes the form of a housing having two or more internal chambers. The housing has an upper hollow engaging cap portion and a lower complementary body portion where the cap portion and body portion together form the internal hollow volume having two or more chambers. One chamber includes the locking mechanism, a receptacle cavity which is accessible within the internal chamber or at a point through the housing, and an active locking element. A flexible securing member having one end permanently affixed to the lock unit within the chamber and the other end of the member having a pin which is adapted to enter the receptacle cavity of the lock unit and to interlock thereon. The second internal chamber is useful as a storage chamber for the flexible securing member when the lock is not in use. The flexible securing member is looped about or through a stationary object, such as a pole, or to a large object, such as a chair, and through the object to be secured and locked. The flexible securing member is preferably, a link chain or flexible metal cable. The lock can be easily opened by a key or a combination at a later time when desired.

5 Claims, 2 Drawing Sheets

PORTABLE LOCKING DEVICE

This is a continuation of Ser. No. 881,217, filed July 2, 1986, and now abandoned.

BACKGROUND OF THE INVENTION

1. Field of the Invention

The present invention relates to a portable lock as an anti-theft device, and more particularly to a portable compact lock having a hollow chamber in which the chain or cable portion of the lock is conveniently stored within the lock housing when the lock is not in use.

A number of devices have been proposed for preventing the theft of items when the items are unattended and the owner is not in the immediate vicinity. However, most of the art devices are large in size and difficult to carry.

Another disadvantage of the prior art locking devices is that they are usually quite expensive, bulky in size, and complex in their construction.

It is therefore desirable to construct a compact portable locking device which can be readily carried by a person when it is not in use. When the locking device is needed, it can be opened and quickly connected around the object (or objects) to be secured and to a stationary or large object, such as, a pole, chair or the like to prevent unauthorized removal.

SUMMARY OF THE INVENTION

This invention relates to a small size portable locking device which is basically in the shape of a square or rectangular box, although other similar shapes are contemplated. The box can be held easily in the hand of an adult person.

The exterior of the box is a housing comprising a upper hollow engaging cap portion and a lower complementary body portion such that the cap portion and the lower body portion, when closed upon each other create one or more internal chambers. Each internal chamber itself is comprised of one or more chambers. In one chamber, usually a smaller chamber, is found the locking mechanism. In a second hollow chamber the flexible securing member, such as a link chain or a cable, is stored when the lock is not in use. One end of the flexible securing member is permanently attached inside the chamber to the lock mechanism, and the other end of the securing member is attached to a pin, which connects with the locking mechanism creating an enclosing locking area.

A primary objective of this invention is the construction of a locking mechanism which can easily and quickly lock and secure a moveable object to a fixed object such as a tree or pole, or to a large object, such as a chair.

A further objective of this invention is to construct a locking mechanism which is lightweight, and because of its storage chambers, the lock and the chain occupy a substantially small space when not in use and can easily be carried by an individual.

DETAILED DESCRIPTION OF THE EMBODIMENTS

Figures 1, 2:
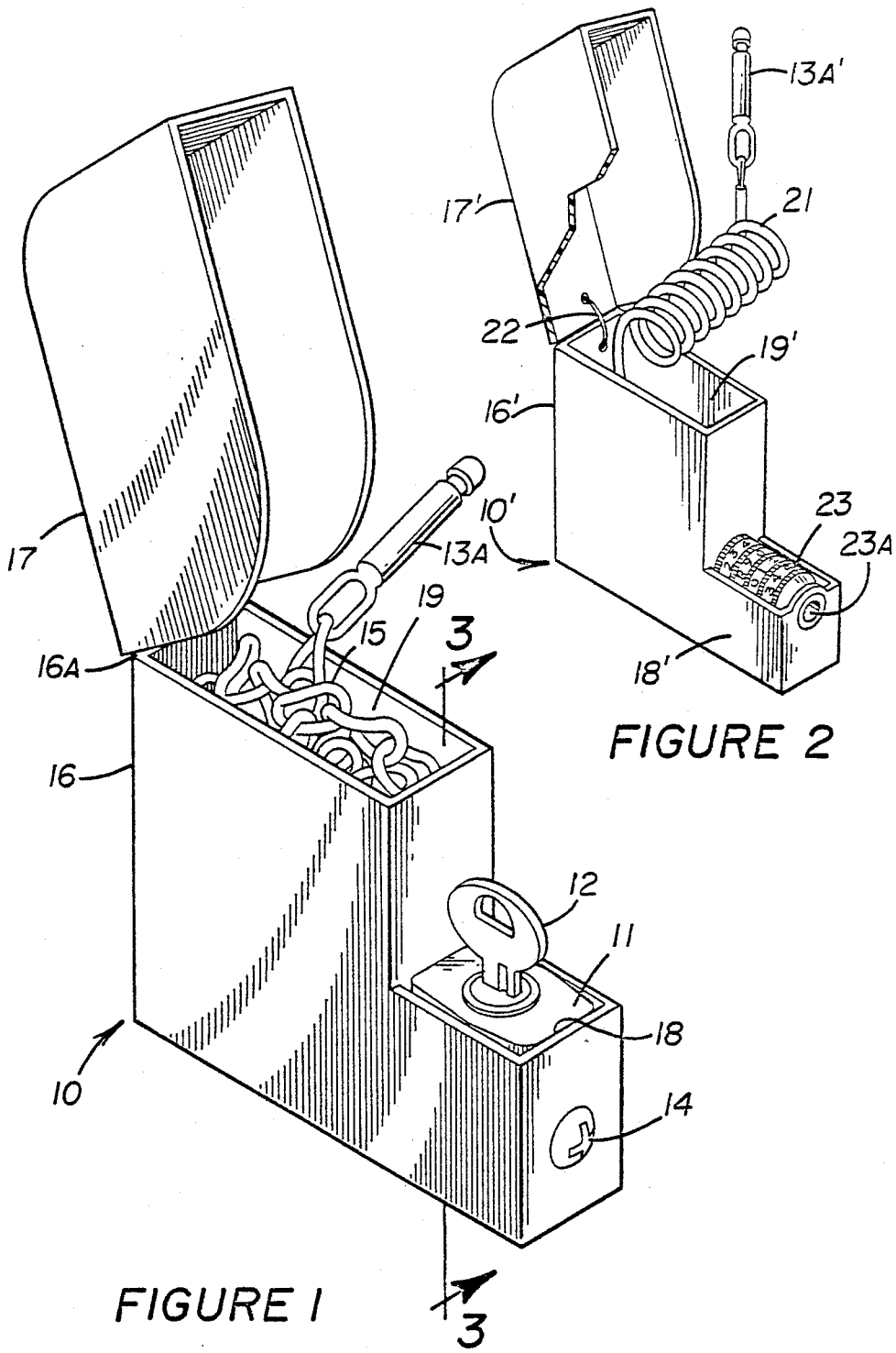
FIG. 1 is an isometric view of the locking device of this invention which is shown in an open state.
FIG. 2 is an isometric view of another embodiment of the locking device similar to FIG. 1.
Figure 3:
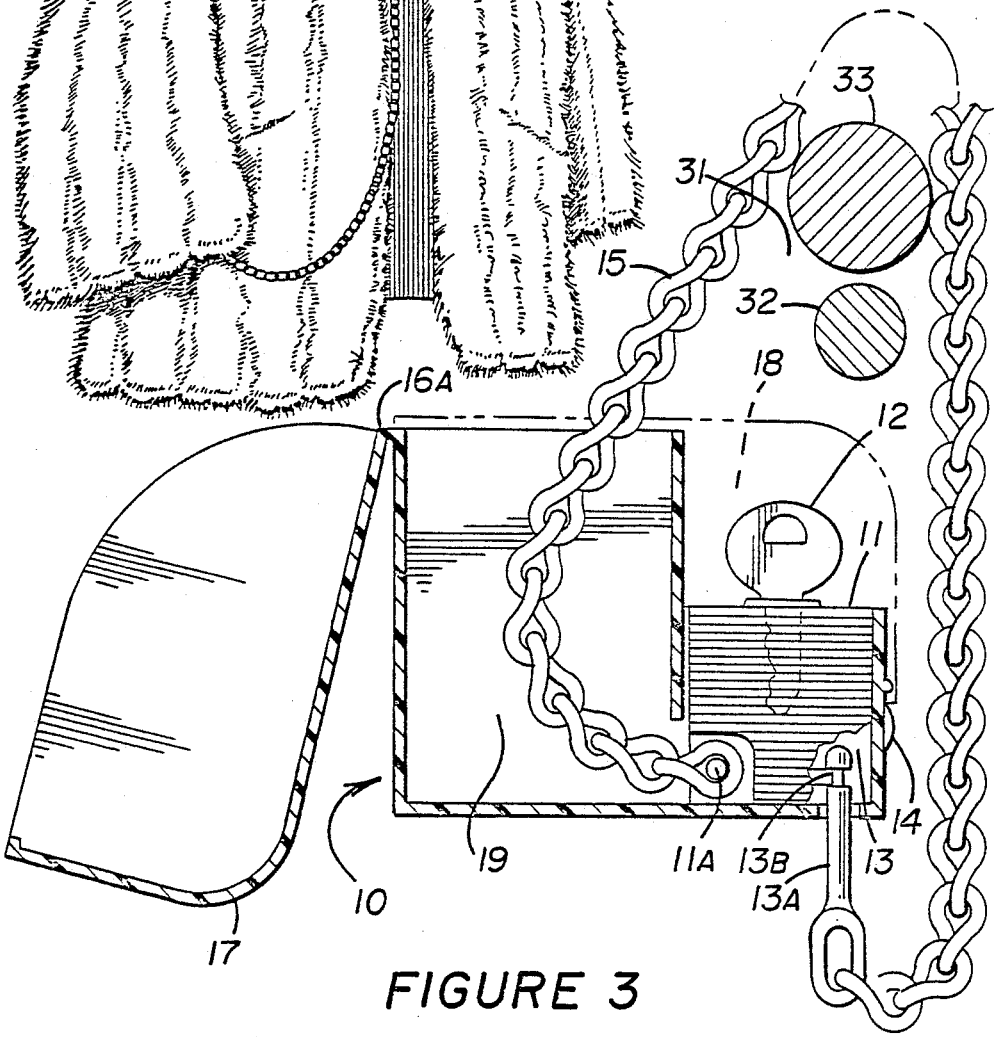
FIG. 3 is a cross-sectional view of the locking device taken when the lock mechanism and pin are in a locking configuration along line 3—3 of FIG. 1 and as shown in the link chain is removed from the storage chamber and in the locked position.

Referring particularly to the drawings, where like numerals designate like parts, there is shown in FIGS. 1, 2 and 3, the compact portable locking device 10 in its component parts. Locking mechanism 11 is shown which is operated using a key 12. Within locking mechanism 11 is a receptacle cavity 13 (See FIG. 3) which accepts pin 13A affixed at one end of the flexible securing member 14. The other end of flexible securing member 14 is securely affixed to locking mechanism 11 at position 11A. Position 11A can be securely affixed at any convenient point on locking mechanism 11. In FIG. 1, the flexible securing member is a chain, such as link chain 15, whereas in FIG. 2 it is cable 21. The housing comprises two parts: hollow cap portion 17 connected to lower complimentary portion 16 by hinge 16A. When cap 17 and lower portion 16 are closed upon each other in this embodiment, two internal chambers 18 and 19 are formed. The first smaller chamber 18 comprises the space for locking mechanism 11 and key 12. The second larger chamber 19 is hollow and of sufficient size for the storage of chain 15 (or cable 21) when the lock is not in use.

The active locking mechanism 11 is of a conventional type wherein the tumblers create a receiver cavity 13 which is in contact with the locking groove 13B of pin 13A in the locked position. When key 12 (in FIG. 1) or the combination 23 (in FIG. 2) are used, the tumblers are released, unlocking locking mechanism 11 and releasing pin 13A. Screw 14 is used to connect lock mechanism to the lower body portion 16 of the housing and is a conventional type.

FIG. 2 is another embodiment of locking device 10' where the housing comprises a hollow cap 17' and lower complementary portion 16' connected by cord 22. In the embodiment in FIG. 2, the cap 17' and body portion 16' are not connected by a hinge but a short cord 22 so that the cap and body portions do not become separated. It is also possible for the housing to be constructed so that the cap portion and body portion snap securely together. When cap 17' and lower portion 16' are closed upon each other, smaller chamber 18' containing combination locking mechanism 23, and larger chamber 9' are created.

In the FIG. 2 embodiment the flexible securing member shown is cable 21 having pin 13A' connected to one end, and the other end of the cable 21 is secured within either hollow chamber 18 or 19 to locking mechanism 23. Pin 13A' fits into receiver cavity 23A of locking mechanism 23. The locking mechanism 23 in FIG. 2 is combination-operated so that the user does not need to be concerned with a key and its possible loss. The present invention contemplates any combination of lock and key mechanism having a link chain or a cable, or a combination lock mechanism having with a link chain or a cable.

As shown in FIG. 1, chain 15 or in FIG. 2, cable 21 has a suitable length which may vary somewhat but generally is sufficiently long to enable it to be looped about a tree, a post, a pole or the like during use. For convenience, cable 21 preferably has a number of spiral convolutions provided throughout its length so that it will store easily in internal hollow chamber 19'.

A cross-section of locking device 10 and chain 15 is shown in FIG. 3. In this configuration enclosed loop 31 is created when pin 13A is inserted into receiver cavity 13. In this view, frame 32 may, for example, represent a cross-section of a bicycle frame which is secured to stationary pole 33.

Figure 4:
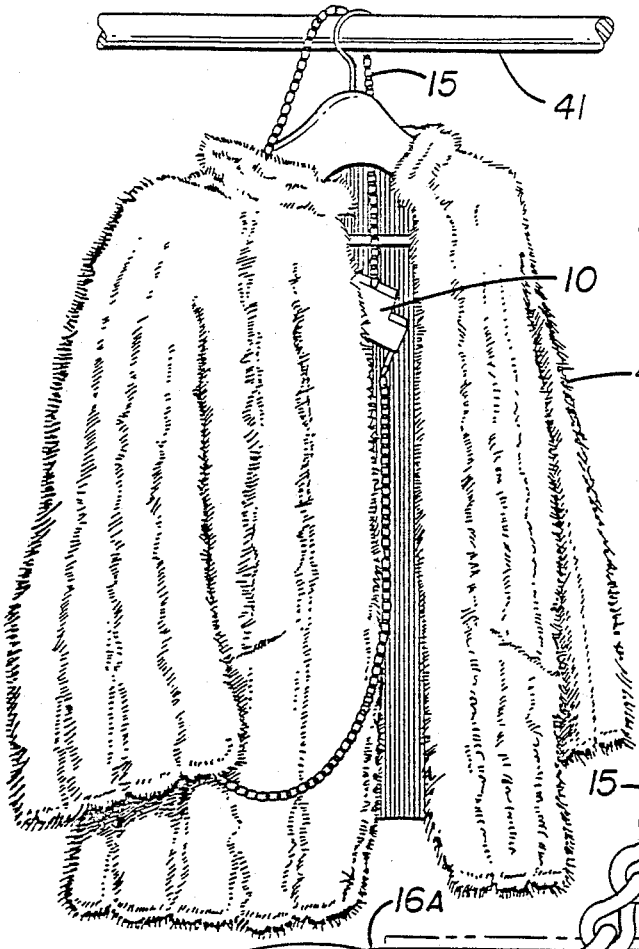
FIG. 4 is a view of the locking device in a locked position as it is used to secure a valuable coat to a horizontal bar.

In FIG. 4, lock device 10 is used to secure a valuable coat 40 to a stationary bar 41 by placing the chain 15 through the arm of coat 40 and locking the end of chain 15 in locking device 10. If no bar or similar stationary object is available, chain 15 can circle, for instance, through the hole created between the arm rest and seat of a chair. Any attempt to remove the coat then requires movement of the chair as well.

It is to be understood that the primary materials used herein will be metal, particularly for the lock mechanism, flexible securing member and housing. In some embodiments any of these elements can be made of other materials, such as plastic, if desired, particularly the housing.

While a few embodiments of the present invention have been shown and described herein, it will become apparent to those skilled in the art that various modifications and changes can be made in the described compact portable locking device without departing from the spirit and scope of the present invention. All such modifications and changes coming within the scope of the appended claims are intended to be covered thereby.

We claim:

1. A compact portable locking device comprising:

(a) a compact portable substantially rectangular housing of a small size to substantially fit in the hand of an adult human being, said housing itself comprising;

(i) an upper hollow non-locking engaging cap portion, and (ii) a lower complementary body portion defining an internal hollow chamber and wherein the cap portion and body portion are hingedly connected at one edge, said cap portion hingedly operable to close said internal hollow chamber;

(b) a locking unit fixedly mounted within and occupying a portion of said internal hollow chamber, said locking unit comprising key locking means operable to secure an object at a location, including an externally opening receptacle cavity and an active locking element in said externally opening receptacle cavity; and (c) a flexible securing member comprising a link chain having one end of said link chain permanently affixed to the locking unit within said internal hollow chamber, and having a pin element affixed at the other end of said link chain and said pin element being adapted to enter said receptacle cavity of said locking unit and to interlock therewith, wherein said internal hollow chamber receives and loosely stores said flexible securing member when said compact portable locking device is not in use.

2. The compact portable locking device of claim 1 wherein said housing comprises a rigid plastic.

3. A compact portable locking device comprising:

(a) a compact portable substantially rectangular housing of a size to substantially fit in the hand of an adult human being and defining an internal hollow chamber, said housing itself comprising;

(i) an upper hollow non locking engaging cap portion, and (ii) a lower complementary body portion wherein the cap portion and body portion are hingedly connected at one edge, said cap portion operable to close said internal hollow chamber;

(b) a locking unit fixedly mounted within and occupying a portion of said internal hollow chamber, said locking unit comprising combination locking means operable to secure an object at a location, including an externally opening receptacle cavity and an active locking element in said externally opening receptacle cavity;

(c) a flexible securing member comprising a link chain affixed at one end to said lower body portion in said internal hollow chamber and having a pin element affixed at the other end thereof, and said pin adapted to enter said receptacle cavity of said locking unit and to interlock thereon with said active locking element, and and wherein said internal hollow chamber receives and loosely stores said flexible securing member when said compact portable locking device is not in use.

4. A compact portable locking device comprising:

(a) a compact portable substantially rectangular housing of a small size to substantially fit in the hand of an adult human being, said housing itself comprising;

(i) an upper hollow non locking engaging cap portion, and (ii) a lower complementary body portion defining an internal hollow chamber wherein the cap portion and body portion are hingedly connected at one edge, said cap portion hingedly operable to close said internal hollow chamber;

(b) a locking unit fixedly mounted within and occupying a portion of said internal hollow chamber said locking unit comprising key locking means operable to secure an object at a location and including an externally opening receptacle cavity and an active locking element in said externally opening receptacle cavity;

(c) a flexible securing member comprising a cable affixed at one end to said lower body portion in said internal hollow chamber and having a pin element affixed at the other end thereof, said pin formed to enter said receptacle cavity of said locking unit and to interlock therewith, and wherein said internal hollow chamber receives and loosely stores said flexible securing member when said compact portable locking device is not in use.

5. A compact portable locking device comprising:

(a) a compact portable substantially rectangular housing of a small size to substantially fit in the hand of an adult human being and defining an internal hollow chamber, said housing itself comprising;

(i) an upper hollow non locking engaging cap portion, and (ii) a lower complementary body portion wherein the cap portion and body portion are hingedly connected at one edge, said cap portion hingedly operable to close said internal hollow chamber;

(b) a locking unit fixedly mounted within and occupying a portion of said internal hollow chamber said locking unit comprising key locking means operable to secure an object at a location, including an externally opening receptacle cavity and an active locking element in said externally opening receptacle cavity;

(c) a flexible securing member comprising a cable affixed at one end to said lower body portion in said internal hollow chamber and having a pin element adapted affixed at the other end thereof, and said pin to enter said receptacle cavity of said locking unit and to interlock thereon with said active locking element, wherein said internal hollow chamber receives and loosely stores said flexible securing member when said compact portable locking device is not in use.

* * * * *